United States Patent [19]

Roulleau

[11] 4,109,572

[45] Aug. 29, 1978

[54] PRINTING MACHINE FOR FLAT ARTICLES

[76] Inventor: Pierre Roulleau, 19 rue Berlioz, Oyonnax, France, 01 104

[21] Appl. No.: 795,360

[22] Filed: May 9, 1977

[30] Foreign Application Priority Data

May 17, 1976 [FR] France ..... 76 15583

[51] Int. Cl.[2] ..... B41F 17/00

[52] U.S. Cl. ..... 101/37; 118/236; 198/625; 214/1 BV

[58] Field of Search ..... 101/37, 36, 35; 198/663, 625, 339; 118/236, 238, 46; 214/1 BV

[56] References Cited

U.S. PATENT DOCUMENTS

| | | | |
|---|---|---|---|
| 1,342,189 | 6/1920 | Stowe | 198/625 X |
| 1,682,431 | 8/1928 | Smith | 118/236 X |
| 2,351,552 | 6/1944 | Shurley | 101/38 A |
| 2,604,200 | 7/1952 | Hohl et al. | 198/459 X |
| 2,854,125 | 9/1958 | Johnson | 198/459 X |
| 3,251,298 | 5/1966 | Rudolph et al. | 101/115 X |
| 3,507,382 | 4/1970 | Wells | 198/625 |
| 3,529,544 | 9/1970 | Oki | 101/35 UX |
| 3,673,953 | 7/1972 | Massari | 101/24 X |
| 3,735,697 | 5/1973 | Provan | 101/37 |

FOREIGN PATENT DOCUMENTS

| | | | |
|---|---|---|---|
| 805,036 | 8/1936 | France | 101/37 |
| 482,675 | 4/1938 | United Kingdom | 198/339 |

*Primary Examiner*—Clifford D. Crowder
*Attorney, Agent, or Firm*—Dowell & Dowell

[57] ABSTRACT

A machine for printing both sides of flat articles such as phonographic records, comprises a feeding station including an inclined belt conveyor on which the records to be printed are piled, an oscillating arm with a pneumatic cup to withdraw at each time the last lowermost article of the pile, while the latter is retained, a screw conveyor formed of parallel screws on which the articles are successively laid by the oscillating arm, the edge of the said articles being retained between two successive turns of the screws, a first printing station disposed above the screw conveyor, first means to raise successively each article from the screw conveyor to the first printing station and to thereafter return it onto the screw conveyor, and a second printing station disposed downstream of the first one, also above the screw conveyor, and second means to raise and lower the articles towards and from the said second printing station.

10 Claims, 10 Drawing Figures

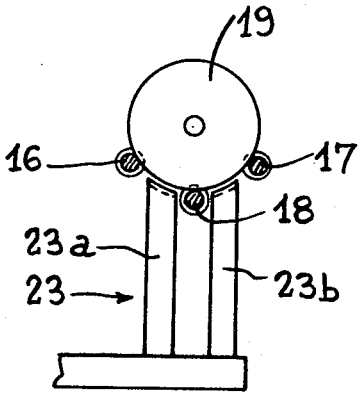
Fig. 2
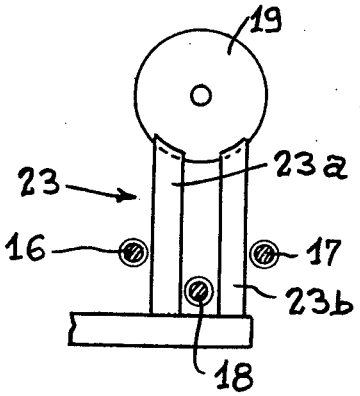
Fig. 3
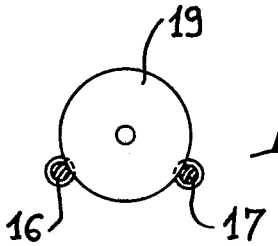
Fig. 4
Fig. 5
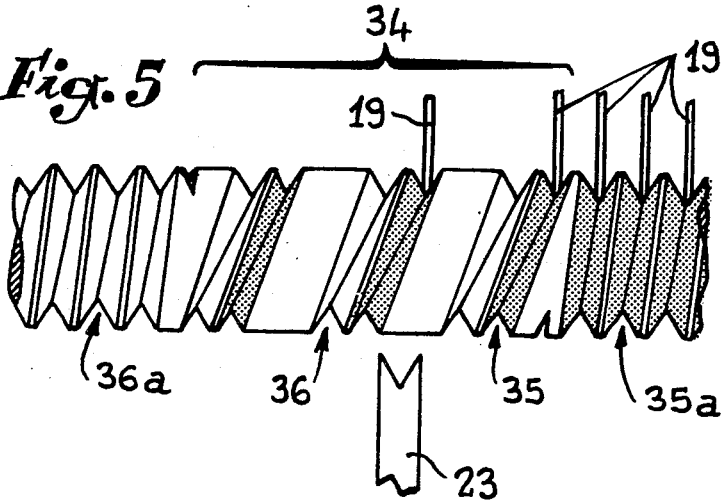

PRINTING MACHINE FOR FLAT ARTICLES

The present invention relates to a machine for the automatic printing of flat articles and more particularly of musical records.

It is known that such records have in the center of each of their sides a label which bears the information concerning their contents. The manufacture and the application of these labels are relatively expensive and it has therefore been attempted to directly print the titles and like information on the records.

But a problem arises when it is desired to use conventional printing methods for this purpose owing to the fact that light colors are then to be printed on a black background. Such is more particularly the case for the so-called offset process which permits multi-color printing, but only on a substantially white surface.

It has therefore been suggested to provide a preliminary operation wherein a layer of substantially white varnish or ink is applied onto the zone to be printed. This zone may thereafter receive the multicolor printing desired without any difficulty. The first operation may be effected by flexography and the second one by the dry offset method. But of course this requires two particular machines.

It is an object of this invention to provide a combined machine which may perform automatically the application of a substantially white layer onto the central zone of each side of musical records and thereafter the printing of the title and associated information on these layers without requiring any intermediate handling of the records.

A further object of the present invention is a combined machine as aforesaid, wherein the records to be printed are carried in succession by a screw conveyor and are raised from same to be brought to a first printing station wherein the background is printed on their central portion, then returned onto the screw conveyor, and thereafter again raised therefrom towards a second printing station and returned onto the said screw conveyor.

Another object of this invention is to provide such a machine including a feeding station in which the records are piled on an inclined belt conveyor, the last lowermost article of the pile being withdrawn from the pile by a pneumatic annular cup and brought on the upstream end of the screw conveyor in synchronism with the operation of same.

In the annexed drawings:

FIGS. 2 and 3 are diagrammatical sections showing how the records are raised from the screw conveyor to be brought to a printing station.

FIG. 4 is a diagrammatical section taken in the downstream portion of the screw conveyor wherein the records are supported by only two screws.

FIG. 5 is a fragmental side view of one of the screws of the screw conveyor illustrating the portion of said screw situated below one of the printing stations of the machine.

Figure 1:
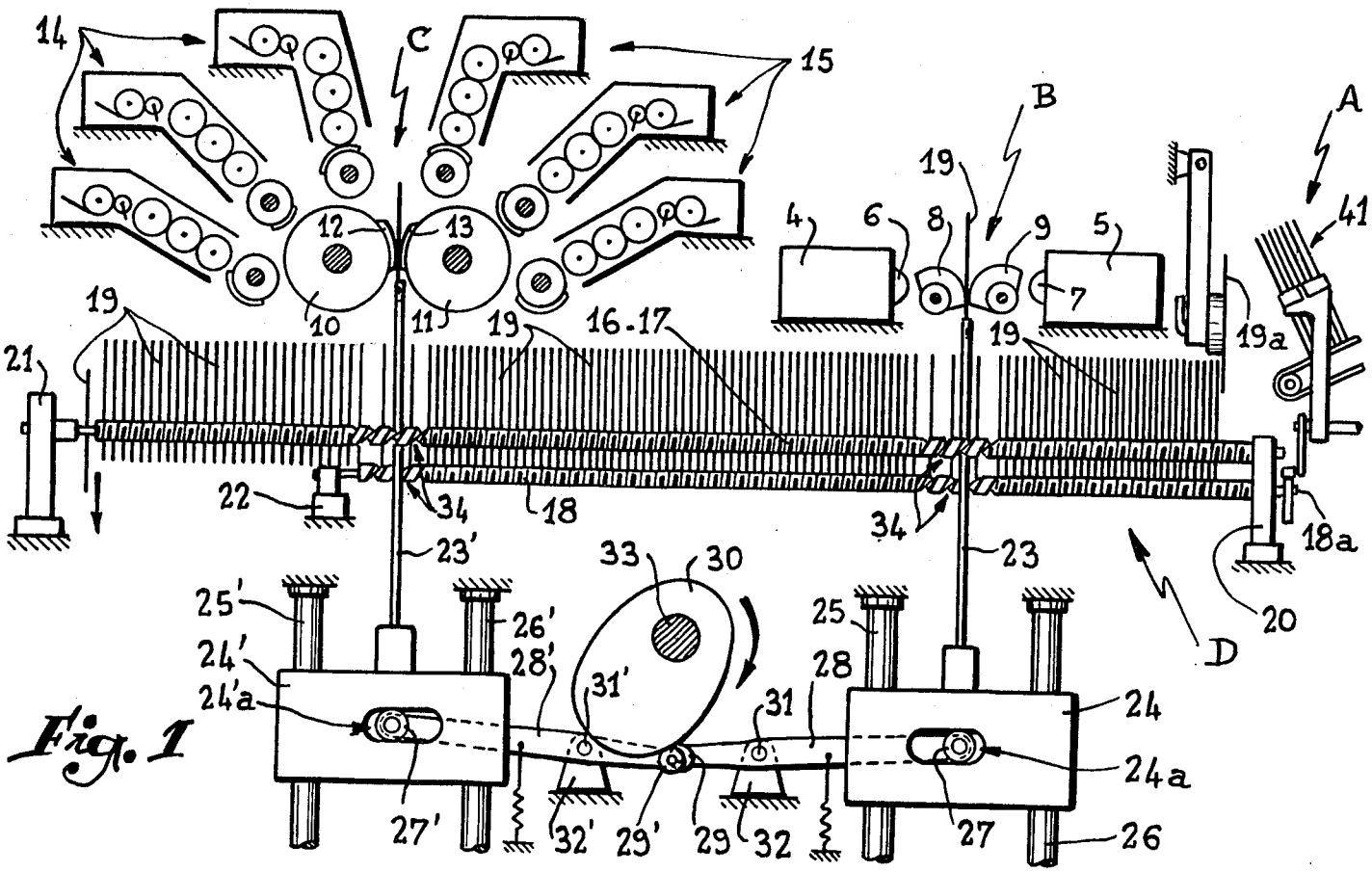
FIG. 1 is a general longitudinal section illustrating somewhat diagrammatically the essential parts of a machine according to this invention.

The printing machine illustrated in FIG. 1 comprises a frame (not shown) which supports a feeding station A, a flexography printing station B, an offset printing station C and a screw conveyor D the longitudinal axis of which is perpendicular to the printing planes of stations B and C.

The feeding station A will be described below with reference to FIG. 10. As to the printing stations B and C, since stations of this kind are well-known in the art, they need not be described in details. It will only be noted that station B comprises a pair of ink containers 4 and 5, each of which contains a number of inking rollers the last one of which 6, respectively 7, cooperates with a printing sector 8, respectively 9. As to the offset station C, it includes in the conventional manner a pair of cylinders 10, respectively 11, each carrying a transfer sector or blanket 12, respectively 13. Each cylinder is associated with a printing block system formed of three elementary heads 14, respectively 15, adapted to cooperate with the respective transfer blankets 12, 13. It will be understood that since each printing station B, C comprises two printing elements 8, 9 or 12, 13 which operate in facing relation, it may effect simultaneously the printing of both sides of each of the successive records.

The screw conveyor D comprises three parallel screws 16, 17, 18 (see also FIGS. 2 and 3) disposed at the apices of an inverted isosceles triangle, i.e., with screws 16 and 17 substantially in the same horizontal plane, while screw 18 is situated at a substantially lower level in a vertical plane equidistant from them. The distance between screws 16 and 17 is such that a record such as 19 disposed vertically in a plane transverse to these screws, may rest on the bottom of the threads of the latter as shown in FIG. 2. Stated in other words, the width of the free space available between the bottom of the threads of screws 16 and 17 is less than the diameter of the record. Moreover the third screw 18 is disposed at such a level below screws 16 and 17 that when a record such as 19 is supported by these screws, it also rests on the bottom of the threads of screw 18. It will be understood that with such an arrangement the record 19 of FIG. 2 is firmly maintained in a vertical plane without any possibility of taking an oblique position as seen laterally (i.e., as seen in FIG. 1).

Screws 16, 17 and 18 are identical (apart from their length, as explained below) and they are rotated in accurate synchronism by means not shown. Screws 16 and 17 extend between supports 20 and 21, while screw 18 is supported by support 20 at its right-hand end in FIG. 1 and by an individual support 22 at its other end, somewhat downstream of the offset printing station C. With such an arrangement the successive records 19 are strictly maintained in a vertical plane until they have passed through the offset printing station C, after which they enter a drying section (not illustrated) wherein a slight obliquity in the longitudinal direction (i.e., towards the right or towards the left in FIG. 1) is in no way damageable and wherein therefore they may be only supported by screws 16 and 17 as illustrated in FIG. 4.

In the mean transverse plane of each printing station B and C there is disposed a record raising and lowering bifurcated member or fork 23, respectively 23' (FIG. 1) each formed of two flat vertical branches, such as **23*a***, 23*b* (FIGS. 2 and 3) disposed in a transverse plane and which are vertically movable between the successive screws 16, 18 and 17. The upper end of each branch is formed with a V-shaped notch which extends transversely to the screws along a more or less arcuate line so as to fit against the periphery of a record 19. Since the latter is strictly maintained in a vertical plane below each printing station, it may thus be caught and raised while remaining exactly vertical, as indicated in FIG. 3.

Each fork 23, 23' is rigidly secured to a carriage 24, 24' slidably guided by vertical columns 25, 26, respectively 25', 26'. Each carriage has a horizontally elongated opening **24*a*, 24*a*' which receives a roller 27, 27' rotatably mounted at one end of a lever 28, 28', the other end of which carries a second roller 29, 29'. Rollers 29, 29' are disposed with their axes approximately in the same transverse plane (with respect to the screw conveyor 16, 17, 18) and they are actuated by a common cam 30. For this purpose levers 28 and 28' are pivoted respectively at 31, 31' on individual supports 32, 32' provided between carriages 24, 24', while cam 30 is keyed on a transverse shaft 33** which is rotated in unison with the screws as more fully explained below.

As shown in FIG. 1, each screw 16, 17, 18 comprises below each printing station B, C a section 34 such as illustrated in FIG. 5. Each section 34 has two threads 35, 36 disposed side by side, with the same pitch, but displaced angularly through 240° with respect to each other in the direction of rotation of the screw. Thread 35 forms an extension of the single thread **35*a* of the upstream portion of the screw, while thread 36 forms the beginning of the single thread 36*a* of the downstream portion thereof. The common pitch of threads 35, 36 in each section 34 is preferably three times the pitch of the threads 35*a* and 36*a*** upstream and downstream of the said section.

It will be understood that in each section 34 the longitudinal speed of the records carried by the screws is three times their speed in the other portions of the screws. This arrangement facilitates the passage of forks 23, 23' between the successive records. It could of course be omitted by providing forks of quite reduced thickness or by increasing the general pitch of the screws along their whole length.

It will be noted that in FIG. 5 for a clearer understanding threads **35*a* and 35 have been shaded to differentiate them from unshaded threads 36 and 36*a***.

Figure 6:
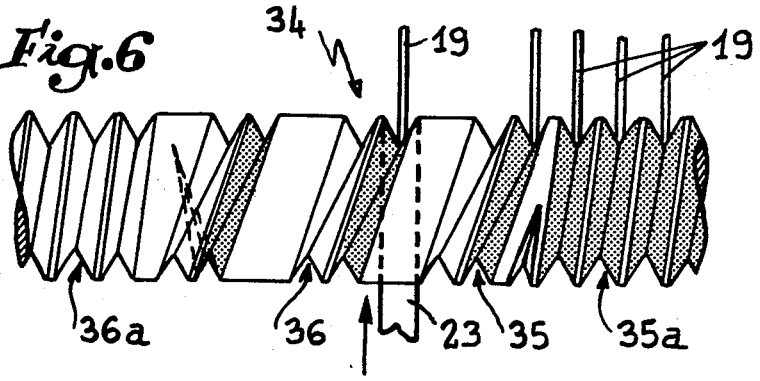
FIGS. 6 to 9 show how the screw portion illustrated in FIG. 5 cooperates with the corresponding bifurcated member which raises the successive records to bring them to the printing station and thereafter returns them onto the screw conveyor.

The records 19 to be printed are laid by feeding station A (see below) on the right-hand end of the screw conveyor D in FIG. 1. They are thus progressively advanced towards the left until they reach the first sections 34 on screws 16, 17, 18. As clearly shown in FIG. 5 they follow in these sections the thread referenced 35 since the latter forms an extension of the thread **35*a* in which they had been disposed. As soon as one of them, as for instance the first one, comes in the mean vertical plane of the corresponding fork 23 (FIG. 5) it is raised by the latter which rises under the action of cam 30 (FIG. 6) without engaging the following or second record carried by the screws. The raised record is thus brought to the level of the flexography printing station B. Owing to the shape of the printing sectors 8, 9, it is not inked during this ascending motion, but when fork 23** returns to its lower position, these sectors apply to the central portion of both sides of the record a thick layer of a white or light color varnish or ink adapted to act as a background for the further printing in station C.

Cam 30 is so arranged and timed that this up and down motion of fork 23 and of the record 19 which it supports takes place during two thirds of a complete revolution of screws 16, 17 and 18, i.e., during the time required for rotating the said screws through an angle of 240°, in such manner that when the printed record re-engages the screws, it is received in the second thread 36 of section 34. It is thus advanced by the latter.

Figure 7:
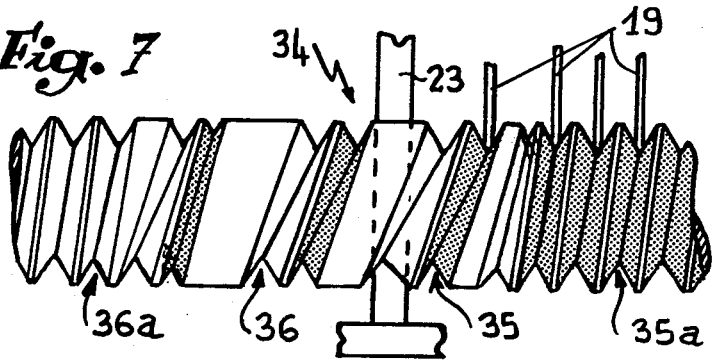
Figure 8:
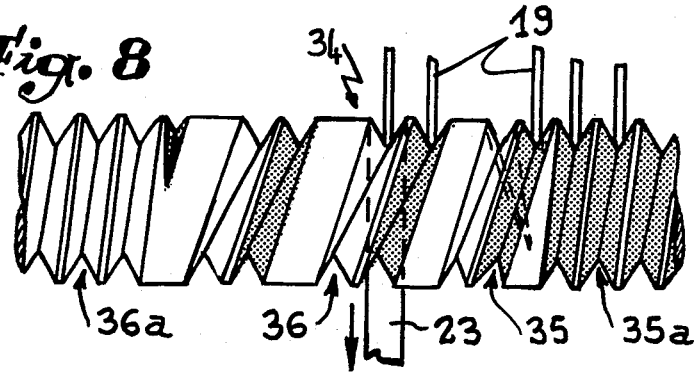
Figure 9:
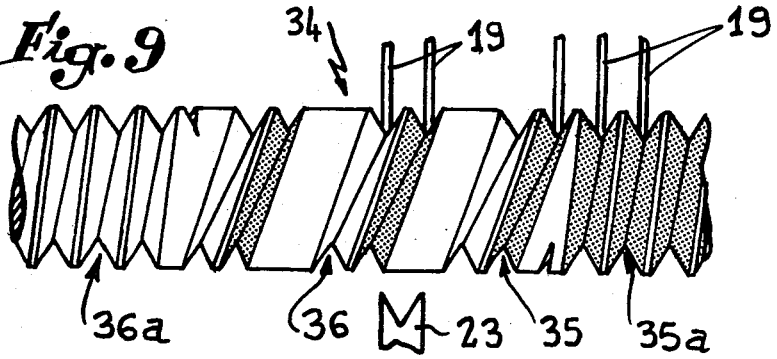

FIG. 7 shows the position of a screw when the first record is at its highermost position. It will be noted that the next or second record 19 has just engaged section 34. FIG. 8 illustrates the position when the first record has just been received in thread 36; the second record has advanced in thread 35 and the distance between both records corresponds to 120° of rotation of the screw. FIG. 9 shows the position of the parts somewhat before the second record reaches the vertical plane of fork 23 to be raised by the latter. The first and the second records are still at a distance from each other corresponding to 120° and owing to the fact that in section 34 the pitch is three times longer than in the other portions of the screws this distance is equal to the distance between the successive records in the upstream portion of the said screws.

The same operative steps take place when the record under consideration reaches the offset printing station C.

Of course drying means could be provided between printing stations B and C and/or downstream of station C. Also the machine could comprise more than two stations, if required.

It is also obvious that the pitch of threads 35, 36 in sections 34 could be more or less than three times the pitch in the other portions of the screws. The angular difference between threads 35 and 36 could also be more or less than 240° as above described.

It should further be noted that in some cases it may be of advantage to provide a longer pitch in the upstream portion of the screws (between support 20 and station B) to facilitate the putting in position of the successive records by feeding station A.

Figure 10:
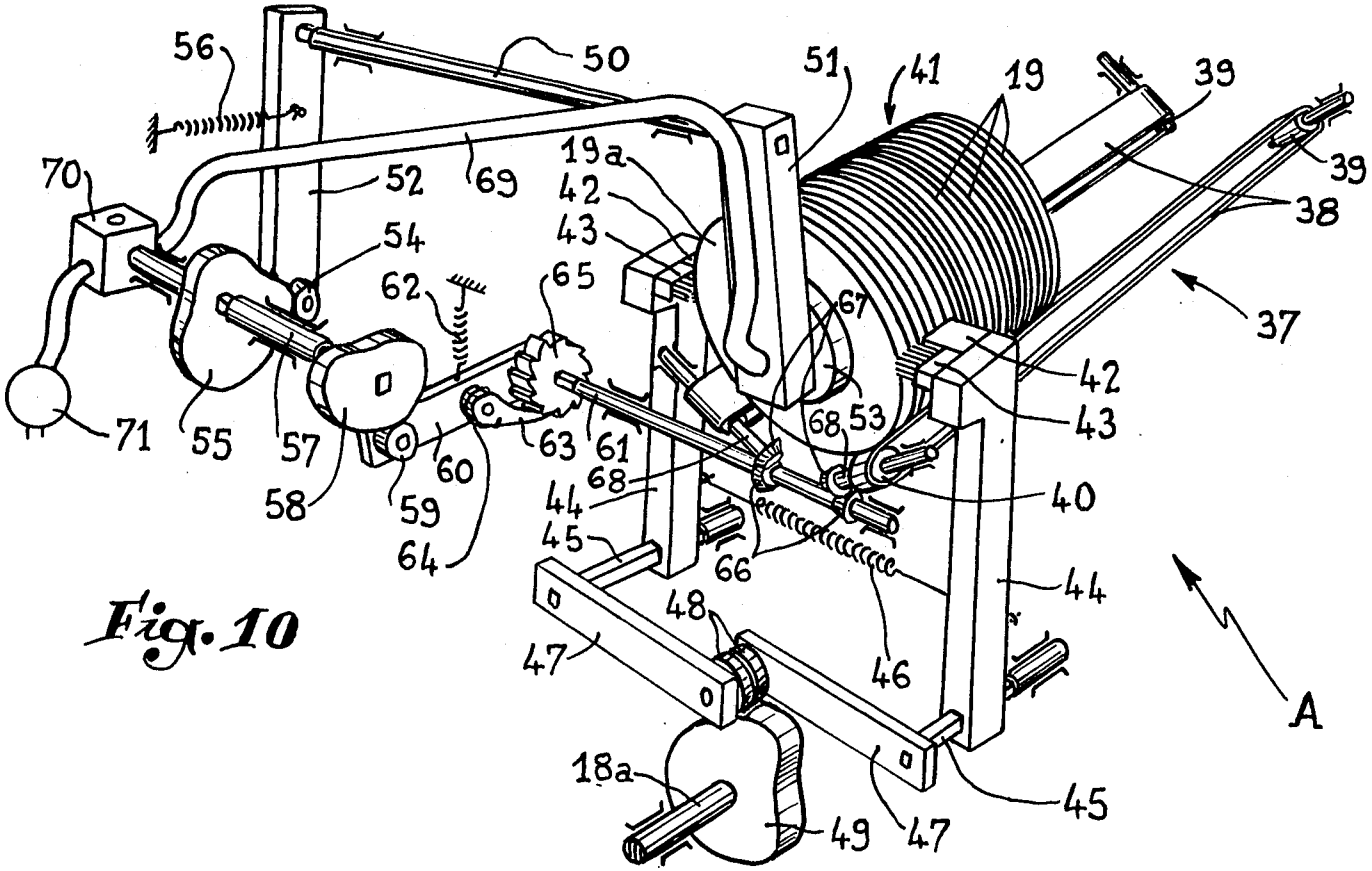
FIG. 10 is a perspective view showing the detail of the feeding station provided at the upstream end of the screw conveyor.

The records to be printed are successively laid onto the upstream end of the screw conveyor D by the feeding station partially indicated at A in FIG. 1 and which has been illustrated in perspective in FIG. 10. This station comprises a belt conveyor generally referenced 37, and formed of two endless belts 38 each supported by a loose roller 39 and by a driving roller 40. As shown the axes of these rollers are inclined in such manner that the upper runs of the belts determine in transverse section a V-shaped profile adapted to receive a pile 41 of records 19 to be printed. Furthermore belts 38 are inclined longitudinally such that the pile tends by gravity to move towards the upstream end of the screw conveyor (which end has not been illustrated in FIG. 10).

Pile 41 may be retained by being clamped between lateral jaws 42 which are applied horizontally against its lateral sides. As illustrated these jaws act at some distance from the lower end of the pile, thus leaving free a few number of records (four in the example illustrated), but to each jaw 42 is associated a brush 43 which engages these records and retains them by a slight frictional action.

Each jaw 42 with its associated brush 43 is carried by an arm 44 keyed on a substantially horizontal shaft 45. Shafts 45 are parallel to each other and a spring 46 attached to arms 44 tends to urge jaw 42 against pile 41. An actuating lever 47 is further secured to each shaft 45, these levers 47 extending towards each other and each carrying at its free end a follower roller 48. A common cam 49 is provided to actuate both rollers 48, this cam being keyed on an extension 18a of the lowermost screw 18.

Feeding station A also includes an upper transverse shaft 50 on which are keyed two levers 51 and 52. Lever 51 carries at its free end a cup 53 of annular cross-section, made of a flexible material such as rubber, for instance and adapted to be applied against the perforated central portion of the last lowermost record 19a of pile 41. The other lever 52 has at its free end a follower roller 54 which cooperates with a cam 55 under the action of a spring 56 attached to the said lever. Cam 55 is mounted on a horizontal shaft 57 which is rotated in synchronism with screw 18, as for instance by being connected with same by an appropriate transmission not illustrated.

Shaft 57 further supports another cam 58 which acts on a follower roller 59 carried by a lever 60 loosely mounted on a horizontal shaft 61 and submitted to the action of a spring 62 which urges roller 59 against cam 58. Lever 60 also carries a pawl 63 loaded by a torsional spring 64 to cooperate with a ratchet wheel 65 keyed on shaft 61. The latter extends below the belt driving rollers 40 and it is connected with each of them by means of a bevel pinion 66 mounted on the said shaft and which meshes with a corresponding bevel gear 67 carried by an extension 68 of the shaft of the corresponding roller.

Cup 53 is connected by a flexible hose 69 with a rotary three-way valve 70 mounted on shaft 57 and which thus connects the said cup either with a vacuum pump 71, or with the outer atmosphere.

During an operating cycle cup 53 is first applied against the central portion of the last lowermost record 19a, as illustrated. It is then connected with pump 71 by valve 70 while jaws 42 clamp pile 41 on belt conveyor 37 which is at standstill. Then cam 5 actuates lever 52, shaft 50 and lever 51 whereby cup 53, now under vacuum, withdraws the last record 19a from conveyor 37 against the slight frictional retaining action of brushes 43 and brings it just above the upstream end of screw conveyor D (position illustrated in FIG. 1). Valve 70 now connects cup 53 to the outer atmosphere and therefore record 19a is liberated and laid on the screw conveyor. Lever 51 thereafter returns to its former position (position of FIG. 10) and cam 58 actuates pawl 63, wheel 65 and shaft 61 to advance belts 38, this advance corresponding to slightly more than the thickness of one record. The next last lowermost record of pile 41 is thus applied against cup 53 and the slight excess of advance of the belts 38 is taken into account by a correspondingly slight slipping of pile 41 on the said belts.

It is obvious that in the case of unperforated circular articles cup 53 need not be annular.

I claim:

1. A machine to print flat circular disc-like articles such as the central portions of phonograph records, the machine comprising:

conveyor means to advance substantially horizontally the articles to be printed standing on the conveyor means in successive substantially vertical transverse planes, the conveyor means comprising substantially horizontal parallel screws with each article to be printed being retained on edge in corresponding threads of said parallel screws, and said conveyor means having an upstream end onto which the articles are loaded;

at least one printing station disposed above said conveyor means and having means operative to contact said central portion of the article when it is raised above the conveyor means into said printing station;

vertically reciprocating means below the conveyor means and operative to raise each successive article from said conveyor means into said printing station and then lower it downwardly onto said conveyor means;

drive means for rotating in unison said screws to advance the articles, and said drive means vertically reciprocating said reciprocating means during a predetermined portion of each rotation of said screws; and each of said screws having an expanded pitch zone of increased thread pitch located opposite to each station and reciprocating means, wherein the thread approaching the expanded zone is separate from the thread departing the expanded zone, and wherein the departing thread begins in the zone circumferentially spaced from the approaching thread by an angular displacement equal to said predetermined portion of one rotation of said screws.

2. In a machine as claimed in claim 1, said conveyor means including three parallel rotating screws the axes of which intersect in a transverse plane the apices of an inverted isosceles triangle, the edges of said articles being engaged in threads of all three of said screws and supported and fully maintained thereby.

3. In a machine as claimed in claim 2, said vertically reciprocating means comprising a bifurcated member having upwardly extending forks which pass between said screws, and the ends of said forks being grooved to engage and retain the edges of said disk-like articles being raised and lowered.

4. In a machine as claimed in claim 1, said approaching and departing threads being angularly displaced about the screws in said zones through about 240° with respect to each other.

5. In a machine as claimed in claim 1, said vertically reciprocating means being so timed with respect to rotation of the screws that an article raised from said approaching thread is returned into said departing thread within the same transverse plane.

6. In a machine as claimed in claim 1, said printing station including sector-shaped printing rollers driven about horizontal axes by said drive means and so timed with respect to the vertical movement of said reciprocating means as to print both sides of an article during movement of the article in one direction of reciprocation while being ineffective during movement in the other direction.

7. A machine to print flat circular disc-like articles such as the central portions of phonographic records, the machine comprising:

conveyor means to advance substantially horizontally the articles to be printed standing on the conveyor means in successive substantially vertical transverse planes, the conveyor means comprising substantially horizontal parallel screws with each article to be printed being retained on edge in corresponding turns of the threads of parallel screws and with said conveyor means having an upstream end;

at least one printing station disposed above said conveyor means;

vertically reciprocating means to raise each successive article from said conveyor means to said printing station and to return it downwardly onto said conveyor means; and an article feeding station including:

a belt conveyor formed of two horizontally spaced parallel belts disposed in an inclined plane, with the distance between said belts being less than the diameter of said articles and with said articles being disposed on said belts standing on edge in a pile having a last lowermost article one side of which is exposed;

clamping means operative to alternately grip and liberate all of the articles in said pile except said last lowermost article and at least one of the adjacent articles;

frictional means to retain with slight friction said last lowermost article and at least one adjacent article;

a circular flexible cup operative to engage the exposed side of said last lowermost article to form a retaining abutment for said pile while same is liberated by said clamping means;

pneumatic means to create a vacuum within said cup to cause same to adhere to and retain said last lowermost article; and actuating means to displace said cup while it is under vacuum and while said pile is retained by said clamping means, to withdraw said last lowermost article from said pile against the action of said frictional means and to bring same above the upstream end of said screw conveyor means, said pneumatic means then causing said vacuum to disappear within said cup to liberate said last lowermost article and to permit same to fall onto said screw conveyor means, and said actuating means thereafter moving said cup against the next last lowermost article of said pile.

8. In a machine as claimed in claim 7, said clamping means comprising:

a pair of jaws;

resilient means to apply said jaws substantially horizontally and laterally against said pile, with said jaws being substantially in a common plane transverse to said belt conveyor; and means to disengage said jaws from said pile when said pile is to be advanced after withdrawal of a lowermost article to bring the next article in position to be withdrawn by said cup.

9. In a machine as claimed in claim 8, said frictional means comprising a pair of brushes each disposed at the side of one of said jaws to be applied by same against at least the two lowermost articles of said pile.

10. In a machine as claimed in claim 7, adapted to print articles having a central hole, said cup being annular and surrounding the central hole.

* * * * *